US009633630B2

(12) United States Patent
Ceccarini

(10) Patent No.: US 9,633,630 B2
(45) Date of Patent: Apr. 25, 2017

(54) KEYBOARD FOR MUSICAL INSTRUMENTS HAVING IMPROVED ERGONOMICS

(71) Applicant: ERGODIESIS S.r.l.s., Legnano (MI) (IT)

(72) Inventor: Paolo Ceccarini, Peschiera Borromeo (IT)

(73) Assignee: ERGODIESIS S.r.l.s., Legnano (MI) (IT)

( * ) Notice: Subject to any disclaimer, the term of this patent is extended or adjusted under 35 U.S.C. 154(b) by 0 days.

(21) Appl. No.: 14/905,734

(22) PCT Filed: Jul. 18, 2014

(86) PCT No.: PCT/EP2014/065503
§ 371 (c)(1),
(2) Date: Jan. 15, 2016

(87) PCT Pub. No.: WO2015/007884
PCT Pub. Date: Jan. 22, 2015

(65) Prior Publication Data

US 2016/0155430 A1 Jun. 2, 2016

(30) Foreign Application Priority Data

Jul. 19, 2013 (IT) ..... MI2013A1213

(51) Int. Cl.
*G10C 3/12* (2006.01)

(52) U.S. Cl.
CPC ..... *G10C 3/12* (2013.01)

(58) Field of Classification Search
CPC ..... G10C 3/12; G10D 13/085
USPC ..... 84/433, 423 R, 432
See application file for complete search history.

(56) References Cited

U.S. PATENT DOCUMENTS 4,444,083 A * 4/1984 Apel ..... G10C 3/12 84/423 R
2004/0007116 A1* 1/2004 Marcus ..... G10C 3/00 84/10

FOREIGN PATENT DOCUMENTS

FR 1054759 A 2/1954
GB 803814 A 11/1958

* cited by examiner

*Primary Examiner* — Kimberly Lockett
(74) *Attorney, Agent, or Firm* — Merchant & Gould P.C.

(57) ABSTRACT

A keyboard for musical instruments includes black keys of a different size with respect to standard keyboards, in order to improve the ergonomics thereof.

16 Claims, 4 Drawing Sheets

KEYBOARD FOR MUSICAL INSTRUMENTS HAVING IMPROVED ERGONOMICS

This application is a National Stage Application of PCT/EP2014/065503, filed 18 Jul. 2014, which claims benefit of MI2013A001213, filed 19 Jul. 2013 in Italy, which applications are incorporated herein by reference. To the extent appropriate, a claim of priority is made to each of the above disclosed applications.

FIELD OF THE INVENTION

The present invention relates to a keyboard for musical instruments comprising at least one octave, wherein the black keys have a different size with respect to standard keyboards, in order to improve the ergonomics thereof.

BACKGROUND OF THE INVENTION

The keyboard is a set of keys that are in general pressed with the fingers of the hands to play certain musical instruments, such as the piano and the organ.

The need to shape the sides of the black keys in a non-traditional way (see FIG. 1 for example), inter alia defining a standardisable and improved measure before a non-uniform production, derives from the difficulty experienced by many pianists with a sturdy build, with large fingers or fingers that insufficiently taper at the tips, in using long fingers between the black keys, or in all piano performance is techniques in which the little finger and, above all, the thumb must use the black keys forcing the other fingers to act between the black keys.

In this sense, the inventor has conducted a survey to measure the width of the middle finger of the right hand at the centre of the nail between the root of the nail itself and fingertip, in subjects of different age, sex, build, pianists and non-pianists. The results are reported in Table below:

| | age | (mm) |
|---|---|---|
| Female child | 12 years of age | 13.85 |
| Man | 44 years of age | 17.53 |
| Man | 60 years of age | 18.85 |
| Woman | 48 years of age | 15.08 |
| Girl | 20 years of age | 15.78 |
| Woman | 45 years of age | 16.59 |
| Woman | 42 years of age | 15.35 |
| Woman | 35 years of age | 14.40 |
| Male child | 12 years of age | 15.32 |
| Man | 47 years of age | 16.49 |
| Man | 27 years of age | 17.70 |
| Woman | 42 years of age | 16.15 |
| Woman | 30 years of age | 15.32 |
| Man | 60 years of age | 17.27 |
| Female child | 13 years of age | 14.76 |
| Man | 19 years of age | 17.47 |
| Man | 36 years of age | 17.53 |
| Man | 45 years of age | 18.31 |
| Man | 23 years of age | 17.46 |
| Woman | 50 years of age | 14.55 |
| Man | 46 years of age | 19.91 |
| Man | 52 years of age | 19.50 |

The penultimate subject is an overweight pianist. All subjects except the last one are engaged in non-manual activities.

Musical instrument manufacturers currently modify the width of the white keys, in the section located between the black keys, leaving the black keys unaltered. This concurs to the reduction of the space for the fingers, especially for the Fa, Sol, La and Ti keys increasing performer discomfort.

There are in fact pianos of different brand, construction year and model, having the following measurements (expressed in mm), wherein:

A: width of the top surface of the black key;

B: width of the black key at the plane defined by the surface of the white keys;

C: width of the portion of white key between one black key and the other, fugues included.

| | A | B | C |
|---|---|---|---|
| Steinway & Sons, Mod. B, 1984 | 9.70 | 11.65 | min. 15.60<br>max. 16.17 |
| Hyundai, baby grand, 1980 | 10.11 | 12.10 | min. 15.63<br>max. 17.28 |
| Scholze, upright 1970 | 9.63 | 11.20 | min. 14.35<br>max. 16.68 |
| Yamaha C3, 1995, Ivorite keys | 9.85 | 11.53 | min. 15.52<br>max. 17.42 |
| Yamaha C3, 1985 | 10.10 | 11.80 | min. 15.78<br>max. 17.34 |
| Yamaha clavinova, 2006 | 10.10 | 11.80 | min. 15.25<br>max. 17.15 |
| Yamaha, studio upright, 2008 | 9.48 | 11.20 | min. 15.75<br>max. 17.11 |
| Yamaha C5, 2005, Ivorite keys | 10.10 | 11.55 | min. 15.30<br>max. 17.42 |

In all keyboards in the prior art, there is a much greater distance (measure C) between the keys C sharp and D sharp.

There is therefore a need to take into consideration the increase, which is proportional to the passing of time, of the average size of a man's body, as widely recorded by evolutionary studies, and thus also of the hands of those who plays keyboard instruments.

The aim of the present invention is, therefore, to overcome the disadvantages set out above in relation to keyboards in the prior art.

SUMMARY OF THE INVENTION

The above-indicated aim was achieved by means of a keyboard for musical instruments comprising at least one octave, wherein:

the keys C# and D# have a width AB HI, H'I', H"I", H'"I'" of 11.10±0.20 mm at the plane Y-Y' defined by the surface of the white keys, and a width DC, ML, M'L', M"L", M'"L'" of 9.90±0.20 mm at the top surface; and the keys F#, G#, and A# have a width EF, NO, N'O', N"O", E'F', N'"O'" of 10.40±0.20 mm at the plane Y-Y' defined by the surface of the white keys, and a width D'C', QP, Q'P', Q"P", D"C", Q'"P'" of 9.90±0.20 mm at the top surface.

In fact, it has been surprisingly found that keyboard ergonomics can be significantly improved by differentiating the widths of the keys C# and D# with respect to the keys F#, G# and A#.

Under another aspect, the invention concerns a musical instrument comprising said keyboard.

For the purposes of the present invention, "musical instruments" shall mean all those instruments equipped with manual keyboard, such as piano (upright/grand), player piano, automatic/midi pianos, electric/electronic/hybrid keyboard, electric/electronic/hybrid piano, "celesta" (or "celeste"), mellotron, harpsichord, synthesizer, organ.

BRIEF DESCRIPTION OF THE DRAWINGS

The features and advantages of the present invention shall become clear from the detailed description provided below, and from the attached drawings, in which.

DETAILED DESCRIPTION OF THE INVENTION

The object of the invention is thus a keyboard for musical instruments comprising at least one octave, wherein:

- the keys C# and D# have a width AB, HI, H'I', H"I", H'"I'" of 11.10±0.20 mm at the plane Y-Y' defined by the surface of the white keys, and a width DC, ML, M'L', M"L", M'"L'" of 9.90±0.20 mm at the top surface; and
- the keys F#, G#, and A# have a width EF, NO, N'O', N"O", E'F', N'"O'" of 10.40±0.20 mm at the plane Y-Y' defined by the surface of the white keys, and a width D'C', QP, Q'P', Q"P", D"C", Q'"P'" of 9.90±0.20 mm at the top surface.

It has been surprisingly found that such measurements given to the keys C#, D#, F#, G# and A# (or more briefly "black keys") do not alter the guiding . . . function for the fingers towards the use of the white keys and do not reduce the width of the support surface on which the fingers press the black keys, in a greater measure than the average of the width of this surface found in the keyboards of the pianos on the market. Moreover, said measures do not fail to maintain continuity with tradition, allowing the position of the centre of the keys to remain completely unaltered, which is of great importance in allowing the performer to find the distances between the keys to which he is accustomed again, but more easily.

Figure 1:
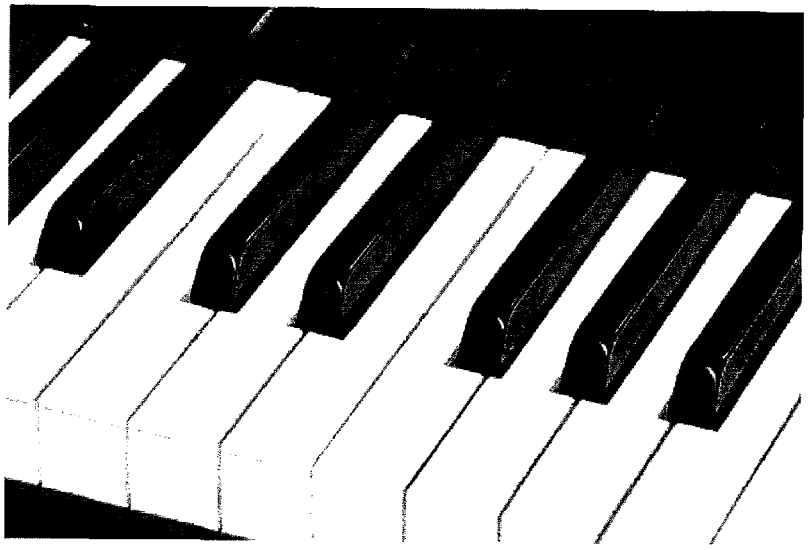
FIG. 1 is a perspective view of a keyboard for a piano of the traditional type.
Figure 2:
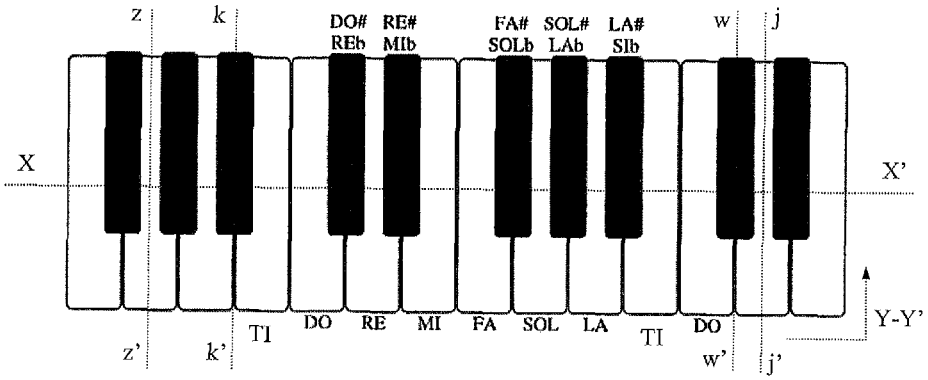
FIG. 2 is a schematic top view of a keyboard.

The keyboard of the present invention also advantageously allows the measurements of the white keys, i.e. the overall length of the white key (understood as being along the plane z-z' of FIG. 2) and the width of the section of the white keys outside the black keys (i.e. the width of the part of the white key facing the performer) to be left unaltered. Indeed, only one adaptation is provided for the white keys in the section inserted between one black key and the other, which advantageously consists of a widening of this section with respect to known is keyboards, thus providing more space for the performer's fingers.

The width of the section of white keys between one black key and the other, obtained by calculating an approximate average estimate between the measurements recorded on multiple known pianos, corresponds, fugues excluded, to the following distribution:

keys C, D, E: 13.10 mm;

keys F, G, A, and B: 12.40 mm.

If the measurement of approximately 1.10 mm of space (or fugue) currently present between white and black keys is to be maintained, the section of the white keys located between the black keys can be adapted, subsequently to the widths of the adjacent black keys according to the present invention.

This adaptation can be advantageously made in the case of the white keys also, by maintaining the position of the centre of the keys. In this sense, in reference to FIG. 2 for example, it is understood that the width of the white keys is centred with respect to the plane z-z' that is perpendicular to the the plane Y-Y' defined by the surface of the white keys and equidistant from the two black keys that are adjacent to the same white key.

As concerns the non-visible portions of the keys (or body of the keys), both black and white, it should be noted that said portions, advantageously, do not need to be modified, or just minimally so, given that the variation in absolute value of the widths of the visible portions according to the present invention is extremely small.

The keyboard of the invention preferably comprises at least three contiguous octaves having the keys DO# and RE# and the keys FA#, SOL#, and LA# as defined above.

More preferably, all the octaves in the keyboard of the invention have the keys C# and D# and the keys F#, G#, and A# as defined above. Said top surfaces of the keys C#, D#, F#, G#, and A# are conveniently parallel to the plane Y-Y' defined by the surface of the white keys.

According to a first embodiment of the present invention, the cross section of each black key is symmetrical with respect to the perpendicular plane to the plane Y-Y' defined by the surface of the white keys and passing at the midpoint of the width of the respective base.

Figure 3:
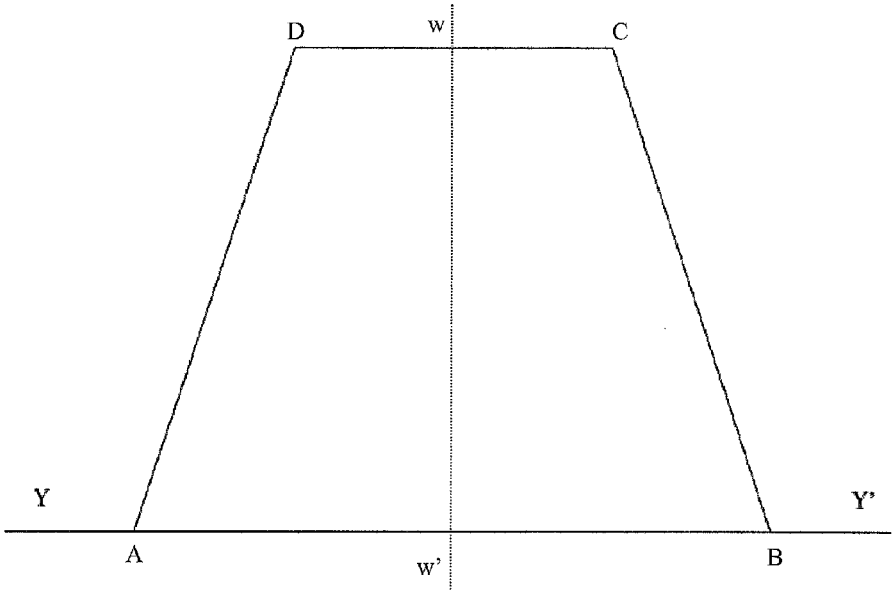
FIG. 3 is a schematic cross section front view along the plane X-X' of a key C# or D# according to a first embodiment of the invention.
Figure 4:
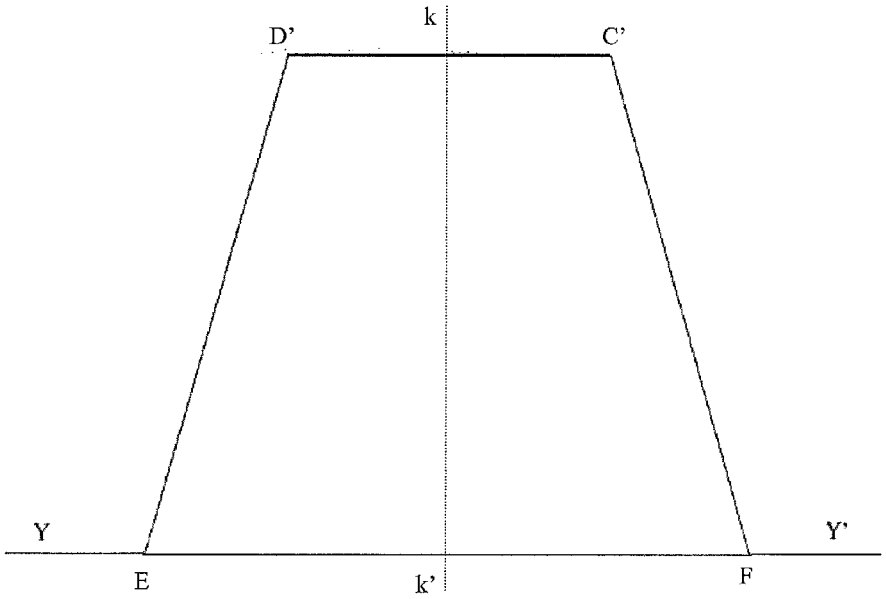
FIG. 4 is a schematic cross section front view along the plane X-X' of a key F#, G# or A# according to a first embodiment of the invention.

With particular reference to FIG. 3-4, the widths AB and CD and the distances AD and BC of the keys C# and D# are symmetrical with respect to the plane ww', which is perpendicular to the plane Y-Y' defined by the surface of the white keys and passing at the midpoint of the width AB of the base, as well as the widths EF, C'D' and the distances ED' and FC' of the keys F#, G#, and A# are symmetrical with respect to the plane k-k', which is perpendicular to the plane Y-Y' defined by the surface of the white keys and passing at the midpoint of the width EF.

Of course, as mentioned, FIGS. 3-4 constitute a schematic and stylized view of the respective sections ABCD and EFC'D', in order to better highlight the 25 symmetry of the sections themselves and the differences between the two groups of black keys C# D# and F#-G#-A#. Thus for greater clarity, said sections ABCD and EFC'D' have been shown in a geometric assimilation in the shape of an isosceles trapezoid, but then in practice, for example, the vertices can then be softened for either aesthetic or practical reasons.

In a second embodiment of the present invention, the lateral surfaces of the keys C# and D#, facing each other, and/or the lateral surfaces of the keys F# and A# facing the key G#, each have an area greater than the area of the corresponding opposite lateral surface. This allows the ergonomics of the resulting octave, and thus of the keyboard that comprises it, to be increased.

Figure 5:
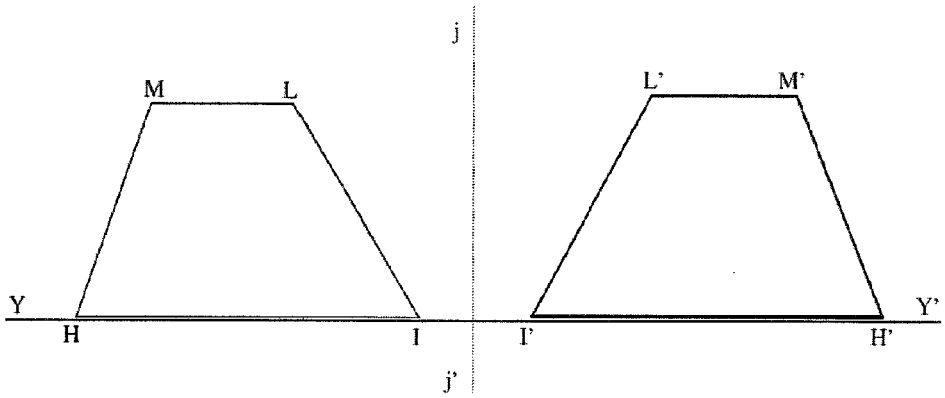
FIG. 5 is a schematic cross section front view along the plane X-X' of the keys C# and D# according to a second embodiment of the invention.
Figure 6:
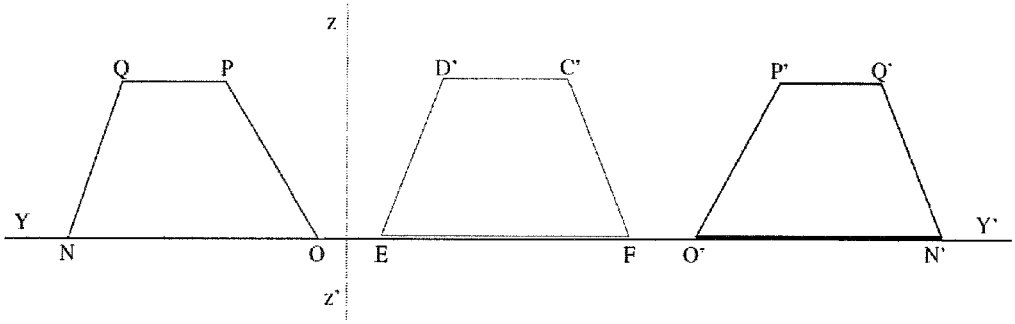
FIG. 6 is a schematic cross section front view along the plane X-X' of the 15 keys F#, G#, and A# according to a second embodiment of the invention.

With particular reference to FIGS. 5-6, it is observed that, in the trapezoidal geometric assimilation, the respective cross sections of the black keys are scalene trapezoids, wherein the longer oblique side faces the closest black key. Thus, in the case of the cross sections HILM and H'I'L'M' of the keys C# and D#, the respective greater oblique sides LI and L'I' are facing each other, while in the case of the cross sections NOPQ and N'O'P'Q' of the keys F# and A#, the respective greater oblique sides PQ and P'Q' are facing the key G#.

The key G# can, on the other hand, maintain the cross section EFC'D' in the shape of an isosceles trapezoid, as in the first embodiment, being in a central position with respect to the keys F# and A#.

In this case also, FIGS. 5-6 constitute a schematic and stylised view of said cross sections, in order to facilitate understanding of the above-described is technical characteristics.

In a third embodiment of the present invention, the lateral surfaces of the keys C# and D#, facing each other, and/or the lateral surfaces of the keys F#, and A# facing the key G# and/or the lateral surfaces of the key G# are longitudinally concave. This allows the ergonomics of the resulting octave, and thus of the keyboard that comprises it, to be increased.

Figure 7:
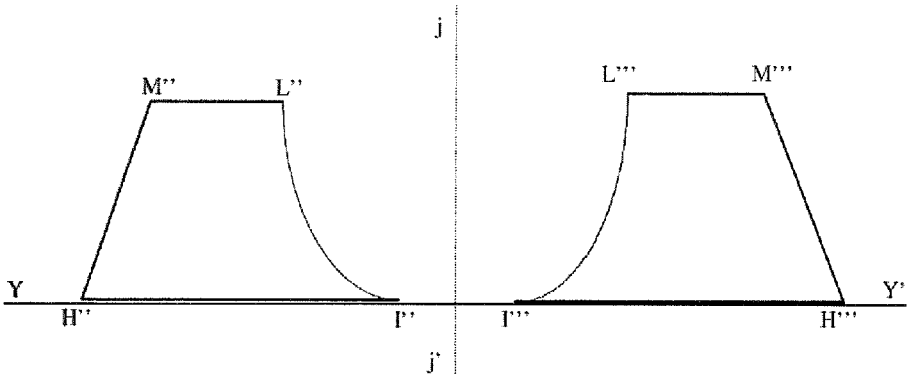
FIG. 7 is a schematic cross section front view along the plane X-X' of the keys C# and D# according to a third embodiment of the invention.
Figure 8:
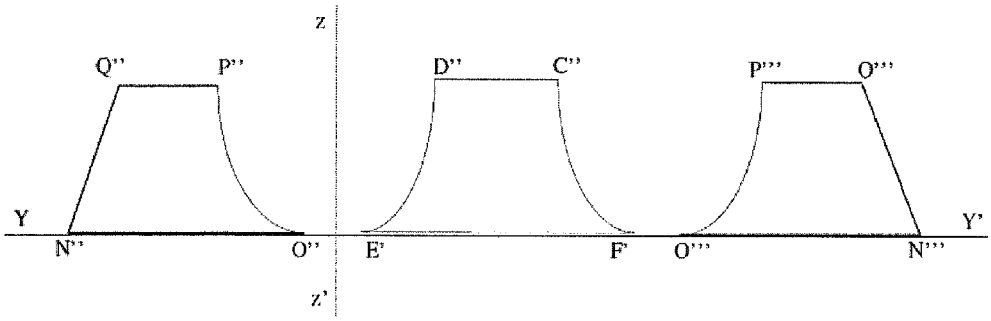
FIG. 8 is a schematic cross section front view along the plane X-X' of the 20 keys F#, G#, and A# according to a third embodiment of the invention.

With particular reference to FIGS. 7-8, it is observed that, in the trapezoidal geometric assimilation, the respective cross sections of the black keys are trapezoids, wherein the oblique side facing the closest black key is replaced by a concave curved line. Thus, in the case of the cross sections H"I"L"M" and H'''I'''L'''M''' of the keys C# and D#, the respective concave curved lines L"I" and L'''I''' are facing each other, while in the case of the cross sections N"O"P"Q" and N'''O'''P'''Q''' of the keys F# and A#, the respective concave curved lines P"Q" and P'''Q''' are facing the key G#.

The key SOL G# can maintain the cross section EFC'D' in the shape of an isosceles trapezoid, as in the first embodiment, being in a central position with respect to the keys F# and A#, or it can have the cross section E'F'C"D" of FIG. 8, wherein both the oblique sides E'D" and F'C" of the trapezoid are replaced by curved concave lines.

In this case also, FIGS. 7-8 are a schematic and stylised view of said cross sections, in order to facilitate understanding of the above-described technical characteristics.

Further embodiments can be obtained, within the same octave, by considering modifying the cross sections of the keys C# and D# differently from the cross sections of the keys F#, G# and A#, for example by producing the keys C# and D# according to the first embodiment and the keys F#, SOL G# and A# according to the third embodiment, or by modifying the cross sections according to the third embodiment, but with different concavities on different black keys.

Moreover, embodiments are possible in which the keys C# and D# have cross sections that have the same area and are specular to each other, as provided for in the first embodiment and as also shown in FIG. 5, wherein the section HILM and section H'I'L'M' have the same area and are symmetrical and specular with respect to the plane j-j' that is perpendicular to the plane Y-Y' defined by the surface of the white keys and that is equidistant from the two black keys in question, or also in FIG. 7, wherein the section H"I"L"M" and the section H'''I'''L'''M''' have the same area and are symmetrical and specular with respect to the plan j-j' that is perpendicular to the plane Y-Y' defined by the surface of the white keys and that is equidistant from the two black keys in question.

The same analogously applies to the keys F# and A#, for which, in FIGS. 6 and 8, the sections NOPQ and N"O"P"Q" have the same area and are specular with respect to the sections N'O'P'Q' and N'''O'''P'''Q'''.

However, other embodiments are also possible wherein said pairs of keys are not specular to each other, in order to make the keyboard as flexible and adaptable as possible to the specific needs of the performer.

Preferably, in said keyboard:

the keys C# and D# have a width AB, HI, H'I', H"I", H'''I''' of 11.10±0.10 mm at the plane Y-Y' defined by the surface of the white keys, and a width DC, ML, M'L', M"L", M'''L''' of 9.90±0.10 mm at the top surface; and the keys F#, G#, and A# have a width EF, NO, N'O', N"O", E'F', N'''O''' of 10.40±0.10 mm at the plane Y-Y' defined by the surface of the white keys, and a width D'C', QP, Q'P', Q"P", D"C", Q'''P''' of 9.90±0.10 mm at the top surface.

More preferably, the keys C# and D# have a width AB, HI, H'I', H"I", H'''I''' of 11.10 mm at the plane Y-Y' defined by the surface of the white keys, and a width DC, ML, M"L", M'''L''' of 9.90 mm at the top surface.

More preferably, the keys F#, G#, and A# have a width EF, NO, N'O', N"O", E'F', N'''O''' of 10.40 mm at the plane Y-Y' defined by the surface of the white keys, and a width D'C', QP, Q'P', Q"P", D"C", Q'''P''' of 9.90 mm at the top surface.

According to an especially preferred embodiment, the keys C# and D# have a width AB, HI, H'I', H'I", H'''I''' of 11.10 mm at the plane Y-Y' identified by the surface of the white keys, and a width DC, ML, M'L', M'L", M'''L''' of 9.90 mm at the top surface, and the keys F#, G#, and A# have a width EF, NO, N'O', N"O", E'F', N'''O''' of 10.40 mm at the plane Y-Y' identified by the surface of the white keys, and a width D'C', QP, Q'P', Q"P", D"C", Q'''P''' of 9.90 mm at the top surface.

Under another aspect, the invention concerns a musical instrument comprising the above-described keyboard. Said musical instrument is preferably a piano, organ or electric piano.

It is to be understood that all aspects identified as preferred and advantageous for the keyboard of the invention are also to be deemed analogously preferred and advantageous for the musical instrument that comprises it.

The invention claimed is:

1. Keyboard for musical instruments, the keyboard comprising a first set of keys having an upper surface defining a keyboard plane, and a second set of keys comprising a base at the keyboard plane and a top above the keyboard plane, wherein the second set of keys comprises a first grouping consisting of C# and D#, and a second grouping consisting of F#, G#, and A#, the first set of keys and the second set of keys forming at least one octave, and wherein each of the keys of the first grouping has a first width of about 11.10±0.20 mm at the base and a second width of about 9.90±0.20 mm at the top; and each of the keys of the second grouping has a first width of about 10.40±0.20 mm at the base and a second width of about 9.90±0.20 mm at the top.

2. The keyboard of claim 1, comprising at least three contiguous octaves, each octave comprising the first grouping and the second grouping of the second set of keys.

3. The keyboard of claim 1, wherein all octaves of the keyboard comprising the first grouping and the second grouping of the second set of keys.

4. The keyboard of claim 1, wherein said top surfaces of the second set of keys are parallel to the keyboard plane defined by the upper surface of the first set of keys.

5. The keyboard of claim 1, wherein each of the keys of the second set of keys comprises a first lateral surface and a second lateral surface opposite the first lateral surface, and wherein the lateral surfaces are concave in a longitudinal direction of the keys.

6. The keyboard of claim 5, wherein lateral surfaces of the keys C# and D# facing each other, and/or the lateral surfaces of the keys F# and A# facing the key G#, each have an area greater than an area of a corresponding opposite lateral surface of the same key.

7. The keyboard of claim 1, wherein each of the keys of the second set of keys comprises a first lateral surface and a second lateral surface opposite the first lateral surface, and wherein the widths and lateral surfaces of the keys C# and D# are symmetrical with respect to a first reference plane perpendicular to the keyboard plane, and the widths and lateral surfaces of the keys F#, G#, and A# are symmetrical with respect to a second reference plane perpendicular to the keyboard plane.

8. The keyboard of claim 1, wherein:

the keys of the first grouping have a first width of 11.10±0.10 mm and a second width of 9.90±0.10 mm; and the keys of the second grouping have a first width of 10.40±0.10 mm and a second width of 9.90±0.10 mm.

9. The keyboard of claim 8, wherein:

the keys of the first grouping have a first width of 11.10 mm and a second width of 9.90 mm; and the keys of the second grouping have a first width of 10.40 mm and a second width of 9.90 mm.

10. A musical instrument comprising the keyboard of claim 1.

11. The keyboard of claim 1, wherein each of the keys of the second set of keys comprises a first lateral surface and a second lateral surface opposite the first lateral surface, and wherein the first lateral surface of each of the keys C#, D#, F#, and A# is set at an angle that is different from the second lateral surface of the same key.

12. The keyboard of claim 1, wherein each of the keys of the second set of keys comprises a first lateral surface and a second lateral surface opposite the first lateral surface, and wherein lateral surfaces of the keys C# and D# facing each other are set at an angle relative to the base, wherein the angle is smaller than an angle of the opposite lateral surfaces of the same keys.

13. The keyboard of claim 1, wherein each of the keys of the second set of keys comprises a top midline longitudinally centered along the top of the key and a base midline longitudinally centered along the base of the key, and wherein the top midline of the keys C#, D#, F#, and A# is not positioned directly above the base midline.

14. The keyboard of claim 1, wherein each of the keys of the second set of keys comprises a first lateral surface and a second lateral surface opposite the first lateral surface, and wherein one of the lateral surfaces of each of the keys C#, D#, F#, and A# is a planar surface.

15. The keyboard of claim 1, wherein each of the keys of the second set of keys comprises a first lateral surface and a second lateral surface opposite the first lateral surface, and wherein one of the lateral surfaces of each of the keys C#, D#, F#, and A# is a concave surface.

16. A keyboard for musical instruments, the keyboard comprising:

a first set of keys having an upper surface defining a keyboard plane, and a second set of keys comprises a first grouping consisting of C# and D#, and a second grouping consisting of F#, G#, and A#, the first set of keys and the second set of keys forming at least one octave, each of the second set of keys comprising a base at the keyboard plane, a top above the keyboard plane, a first lateral surface and a second lateral surface opposite the first lateral surface defining a length, wherein the lateral surfaces of each of the keys C#, D#, F#, and A# are asymmetrical.

* * * * *